US007604368B2

(12) United States Patent
Cheng

(10) Patent No.: US 7,604,368 B2
(45) Date of Patent: Oct. 20, 2009

(54) EXTENSION BAR WITH BUILT-IN LIGHT

(76) Inventor: Chin-Shun Cheng, No. 37-2, Ching-Dau 1st Street, Taichung (TW) 404

( * ) Notice: Subject to any disclaimer, the term of this patent is extended or adjusted under 35 U.S.C. 154(b) by 279 days.

(21) Appl. No.: 11/833,259

(22) Filed: Aug. 3, 2007

(65) Prior Publication Data

US 2009/0034240 A1 Feb. 5, 2009

(51) Int. Cl.
*B25B 23/18* (2006.01)

(52) U.S. Cl. ..... 362/120; 362/119

(58) Field of Classification Search ..... 362/109–120, 362/578, 581; 43/17.5; 81/177.85; 7/170
See application file for complete search history.

(56) References Cited

U.S. PATENT DOCUMENTS 5,477,434 A * 12/1995 Reed ..... 362/119
6,183,103 B1 * 2/2001 Hillinger ..... 362/119
6,508,565 B2 * 1/2003 Wang ..... 362/119
6,712,484 B2 * 3/2004 Hsien ..... 362/119
6,776,500 B1 * 8/2004 Chen ..... 362/119
6,843,579 B2 * 1/2005 Chen ..... 362/119
7,401,938 B1 * 7/2008 Cheng ..... 362/120
7,434,952 B1 * 10/2008 Wang ..... 362/119

* cited by examiner

*Primary Examiner*—Anabel Ton
*Assistant Examiner*—Kevin J. Spinella

(57) ABSTRACT

An extension bar with built-in light includes an elongate body having an open first end and an engaging recess in a second end of the elongate body. A switch member extends through a transverse hole of the elongate body and includes first and second conductive members connected thereto. A power supply unit and a light bulb are received in the passage. The second conductive member is in contact between the power supply unit and a conductive hand tool inserted into the engaging recess to activate the light bulb. The light bulb is also activated when rotating the switch member to contact directly the first conductive member, the second conductive member and the power supply unit.

10 Claims, 12 Drawing Sheets

A-A

EXTENSION BAR WITH BUILT-IN LIGHT

FIELD OF THE INVENTION

The present invention relates to an extension bar which includes a built-in light which is activated by either a switch member on the extension bar or by a hand tool engaged with the extension bar.

BACKGROUND OF THE INVENTION

A conventional hand tool can be connected with variety of connection bars or extension bars which includes accommodation recesses so as to be connected with different tool bits. U.S. Pat. Nos. 5,477,434 and 6,183,103 respectively disclose an extension bar with built-in light to be cooperated with hand tools. The built-in light of U.S. Pat. No. 5,477,434 can be activated when a hand tool is connected with the extension bar, and built-in light of U.S. Pat. No. 6,183,103 cannot be activated by the connection of the hand tool, a switch has to be operated to activate the built-in light.

The present invention intends to provide an extension bar with a built-in light which can be activated by either connecting a hand tool to the elongate body or by operation of a switch member relative to the extension bar.

SUMMARY OF THE INVENTION

The present invention relates to an extension bar with built-in light which comprises an elongate body made by conductive material and includes a first end and an engaging recess is defined in a second end of the elongate body. A transverse hole is defined through the elongate body and communicates with the engaging recess. A passage is defined axially through the elongate body and communicates with the engaging recess and defines an opening in the first end of the elongate body. A switch member made by non-conductive material extends through the transverse hole and includes a first face toward the first end of the elongate body and a second face toward the second end of the elongate body. The switch member is rotatable between a first operation position and a second operation position in the transverse bole. A first recess is defined in the switch member and a first conductive member is engaged with the first recess. A second recess is defined in the switch member and a second conductive member is engaged with the second recess.

A power supply unit and a light bulb are received in the passage. The power supply unit has a first end facing the switch member and a second end of the power supply unit faces a first end of the light bulb. The first end of the light bulb is made by conductive material and in contact with an inner periphery of the passage. A second end of the light bulb faces the opening in the first end of the elongate body.

The first conductive member includes a first conductive portion and a second conductive portion, wherein the first conductive portion is in contact with the elongate body and the second conductive portion is removably in contact with the first end of the power supply unit. The second conductive member has a third conductive portion and a fourth conductive portion, wherein the third conductive portion is located in the first face of the switch member and the fourth conductive portion is located in the second face of the switch member.

When the switch member is located at the first operation position, the third conductive portion of the second conductive member is in contact with the power supply unit. When a conductive hand tool is inserted into the engaging recess and in contact with the with the elongate body and the fourth conductive portion of the second conductive member to form a first circuit "C1" to activate the light bulb. When the hand tool is not inserted in the engaging recess, the switch member is rotated to be at the second operation position, the first conductive portion of the first conductive member is in contact with the elongate body and the second conductive portion of the first conductive member is in contact with the power supply unit so as to form a second circuit "C2", the light bulb is also activated.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
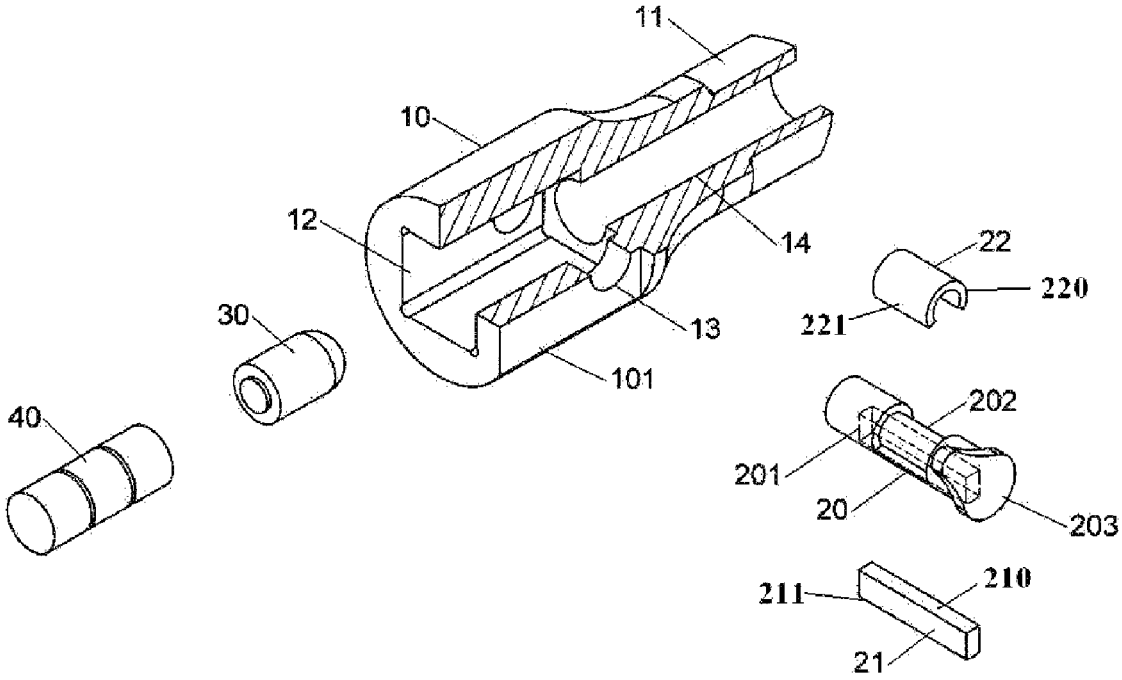
FIG. 1 is an exploded view to show the extension bar with a built-in light of the present invention.
Figure 2:
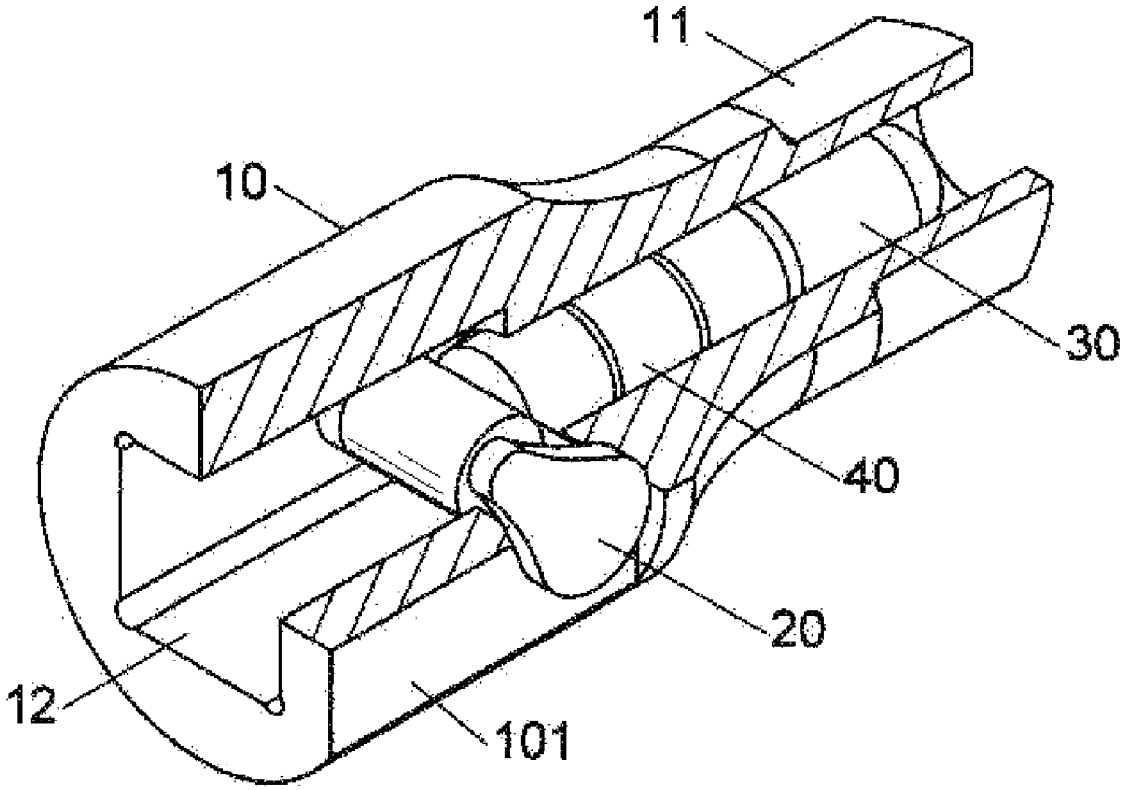
FIG. 2 is a partially cross sectional view of the extension bar with a built-in light of the present invention.
Figure 3:
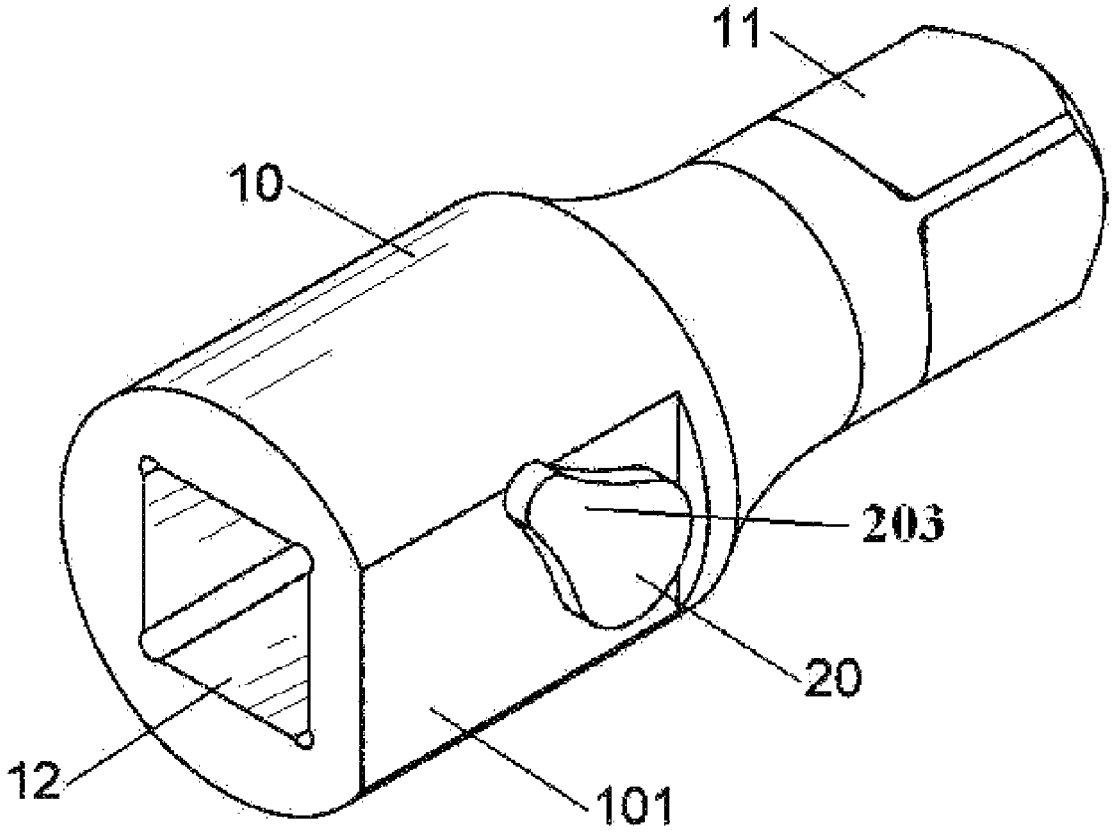
FIG. 3 is a perspective view to show the extension bar with a built-in light of the present invention.
Figure 4:
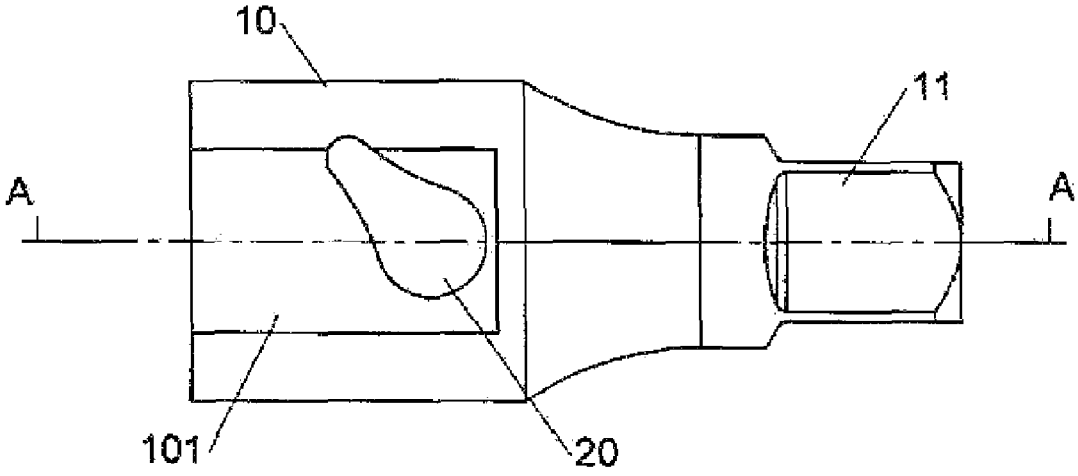
FIG. 4 is a side view to show the extension bar with a built-in light of the present invention.
Figure 5:
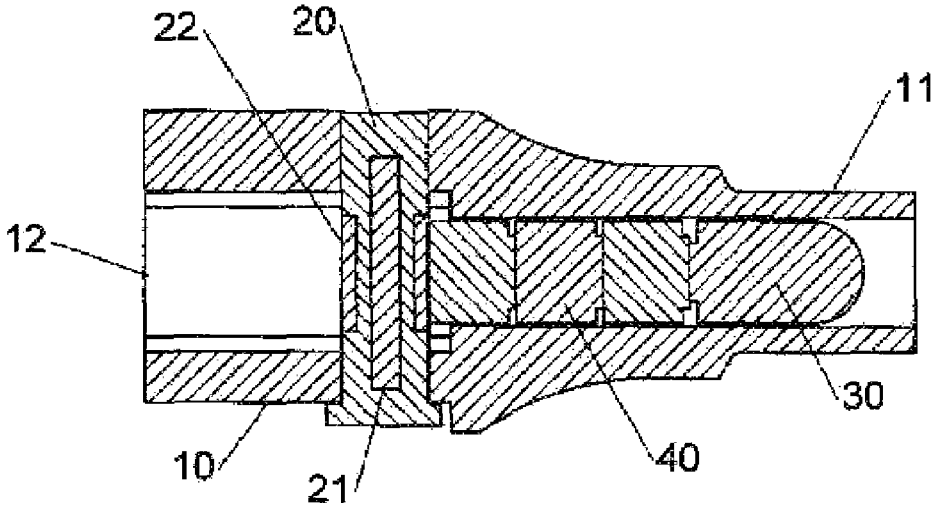
FIG. 5 is a cross sectional view taken along line A-A in FIG. 4.
Figure 6:
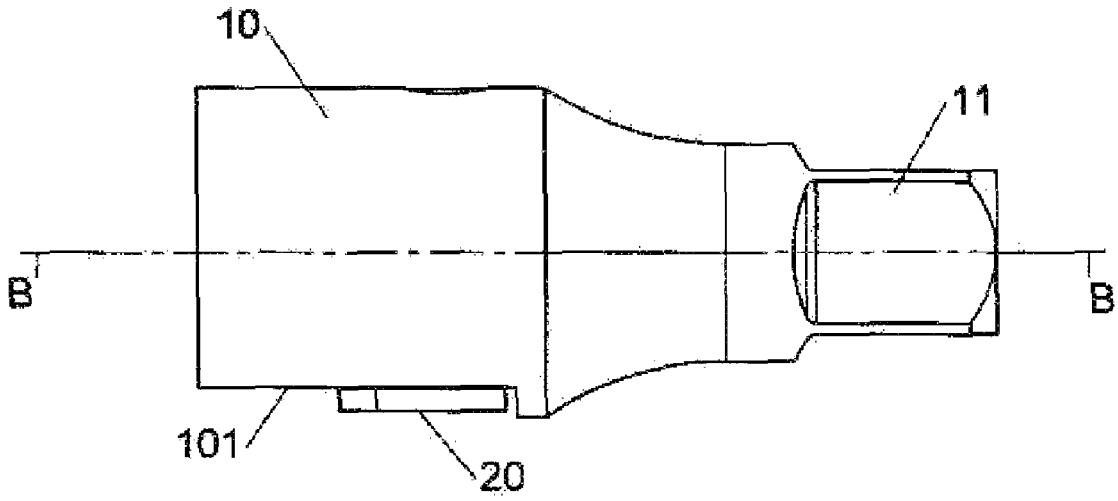
FIG. 6 is another side view to show the extension bar with a built-in light of the present invention.
Figure 7:
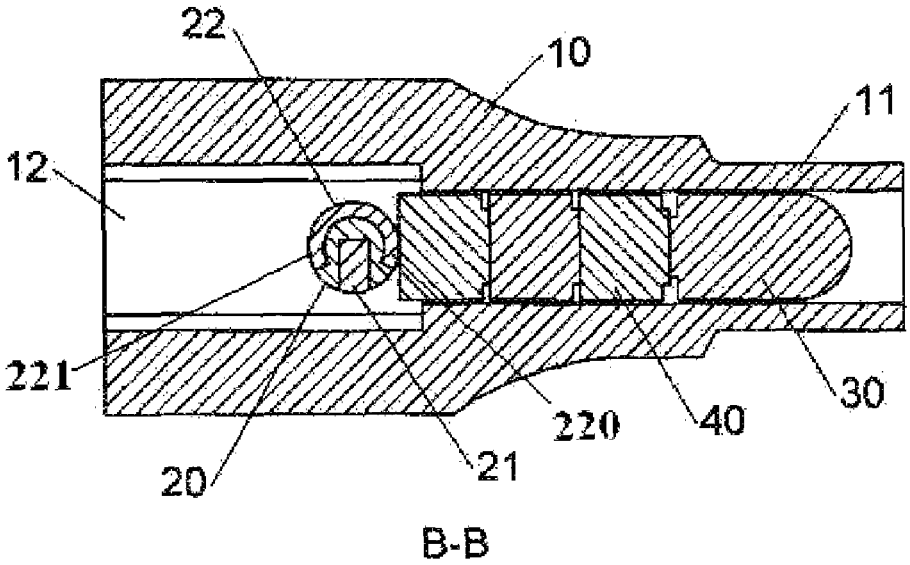
FIG. 7 is a cross sectional view taken along line B-B in FIG. 4.
Figure 8:
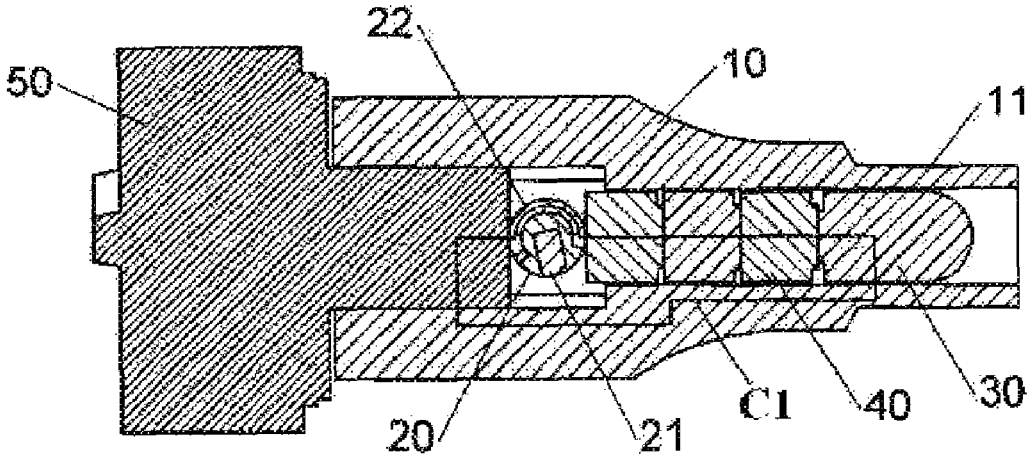
FIG. 8 is a cross sectional view to show a hand tool is inserted into the elongate body to activate the light bulb.

Referring to FIGS. 1 to 7, the extension bar with built-in light of the present invention comprises an elongate body 10 which is made by conductive material and includes a first end and a second end in which an engaging recess 12 is defined. The first end of the elongate body 10 is a rectangular end 11 so as to be connected with other hand tool and the engaging recess 12 is a rectangular recess so as to receive a conductive hand tool 50 as shown in FIG. 8. A transverse hole 13 is defined through the elongate body 10 and communicates with the engaging recess 12. A passage 14 is defined axially through the elongate body 10 and communicates with the engaging recess 12, and defines an opening in the first end of the elongate body 10. A first flat surface 101 is defined in an outer periphery of the elongate body 10.

A switch member 20 is made by non-conductive material and extends through the transverse hole 13. The switch member 20 includes a first face toward the first end of the elongate body 10 and a second face toward the second end of the elongate body 10. The switch member 20 is rotatable between a first operation position and a second operation position in the transverse bole 13. A first recess 201 is defined in the switch member 20 and a first conductive member 21 is engaged with the first recess 201. A second recess 202 is defined in the switch member 20 and a second conductive member 22 is engaged with the second recess 202. The second recess 202 is a curved recess defined in an outer periphery and along an axis of the switch member 20, the second conductive member 22 is a curved plate which is engaged with the second recess 202. A lever 203 extends laterally from an end of the switch member 20 and is rested on the first flat surface 101.

A power supply unit 40 and a light bulb 30 are received in the passage 14, the power supply unit 40 has a first end facing the switch member 20 and a second end of the power supply unit 40 faces a first end of the light bulb 30. The first end of the light bulb 30 is made by conductive material and in contact with an inner periphery of the passage 14. A second end of the light bulb 30 faces the opening in the first end of the elongate body 10.

The first conductive member 21 includes a first conductive portion 210 and a second conductive portion 211. The first conductive portion 210 is in contact with the elongate body 10 and the second conductive portion 211 is removably in contact with the first end of the power supply unit 40. The second conductive member 22 has a third conductive portion 220 and a fourth conductive portion 221, the third conductive portion 220 is located in the first face of the switch member 20 and the fourth conductive portion 221 is located in the second face of the switch member 20.

As shown in FIG. 8, when the switch member 20 is located at the first operation position, the third conductive portion 220 of the second conductive member 22 is in contact with the power supply unit 40, a conductive hand tool 50 is inserted into the engaging recess 12 and in contact with the with the elongate body 10 and the fourth conductive portion 221 of the second conductive member 22 so as to form a first circuit "C1" via the conductive hand tool 50, the elongate body 10, the second conductive member 22, the power supply unit 40 and the light bulb 30, the light bulb 30 is activated.

Figure 9:
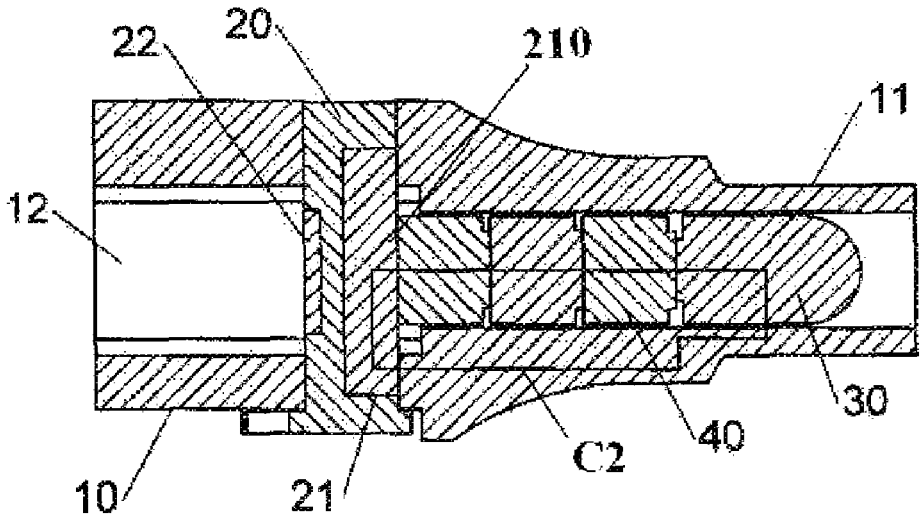
FIG. 9 is a cross sectional view to show that no hand tool is connected and the switch member is rotated to form a circuit C1 to activate the light bulb.
Figure 10:
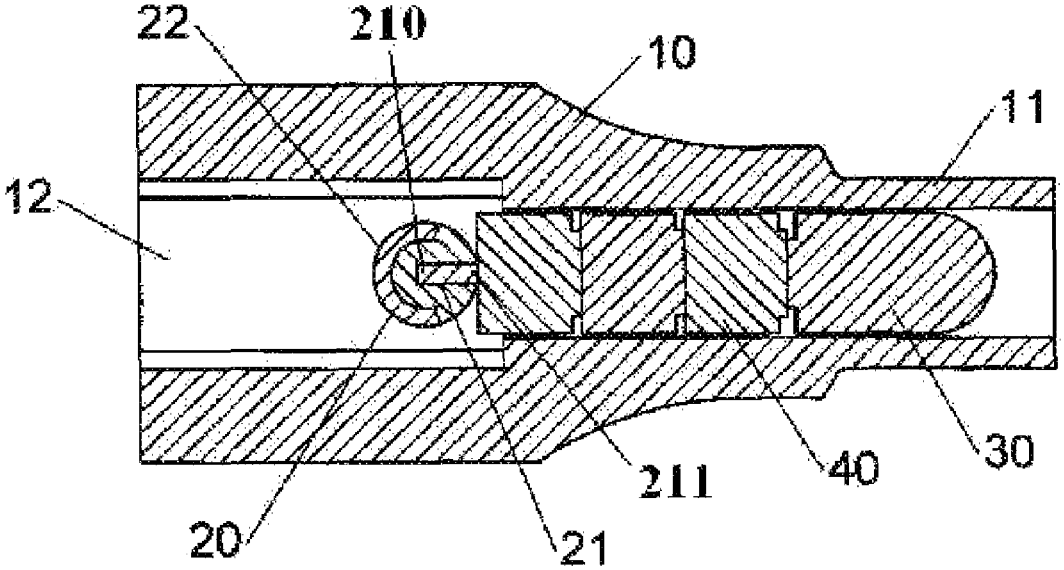
FIG. 10 is a cross sectional view to show that no hand tool is connected and the switch member is rotated to form the circuit C1.

As shown in FIGS. 9 and 10, when no conductive hand tool 50 is inserted in the engaging recess 12, the switch member 20 is rotated to be the second operation position, the first conductive portion 210 of the first conductive member 21 is in contact with the elongate body 10 and the second conductive portion 211 of the first conductive member 21 is in contact with the power supply unit 40 so as to form a second circuit "C2" via the first conductive member 21, the power supply unit 40 and the light bulb 30 and the elongate body 10, the light bulb 30 is also activated.

Figure 11:
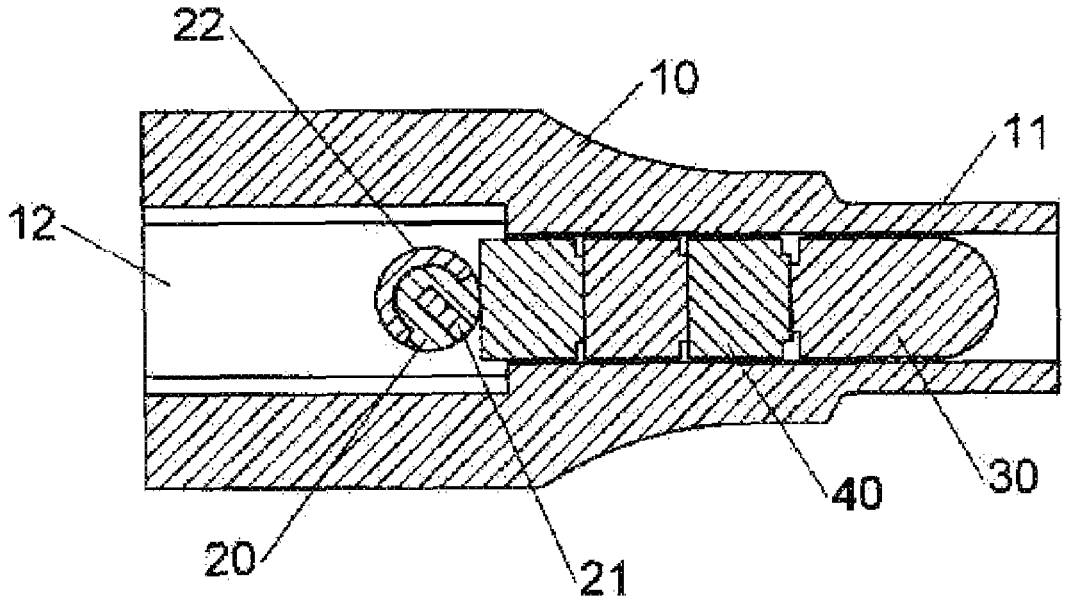
FIG. 11 is a cross sectional view to show a third position of the switch member.

As shown in FIG. 11, the switch member 20 can be operated to a third operation position where the first conductive member 2, the second conductive member 22 and the power supply unit 40 are not in contact with each other. In this position, no circuit is formed and the power of the power supply unit 40 can be saved.

Figure 12:
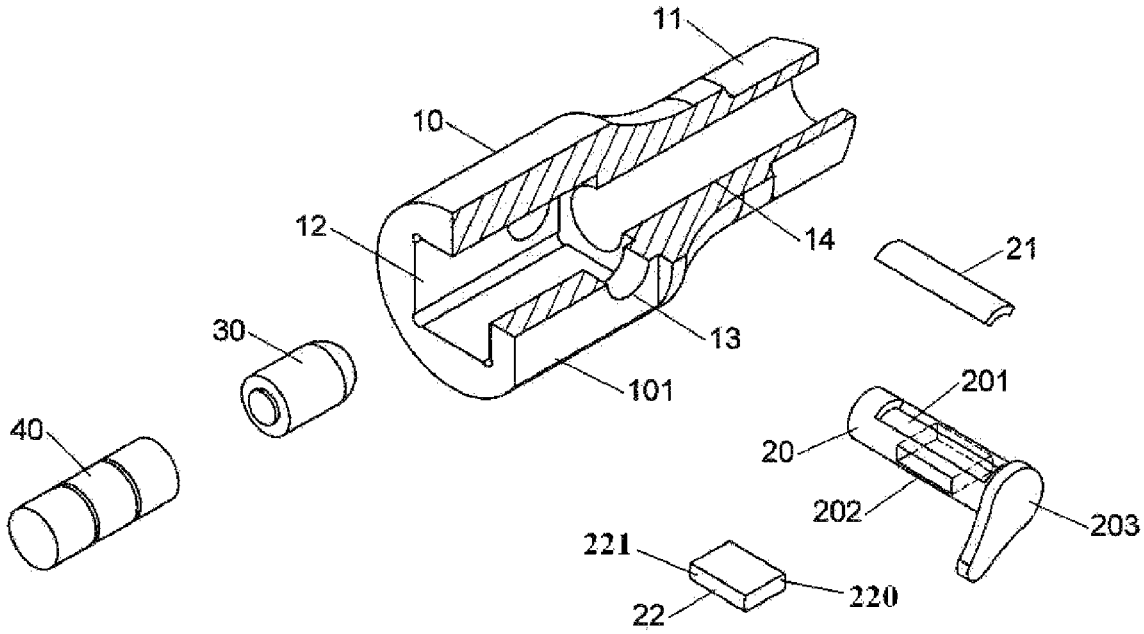
FIG. 12 is an exploded view to show another embodiment of the extension bar with a built-in light of the present invention.
Figure 13:
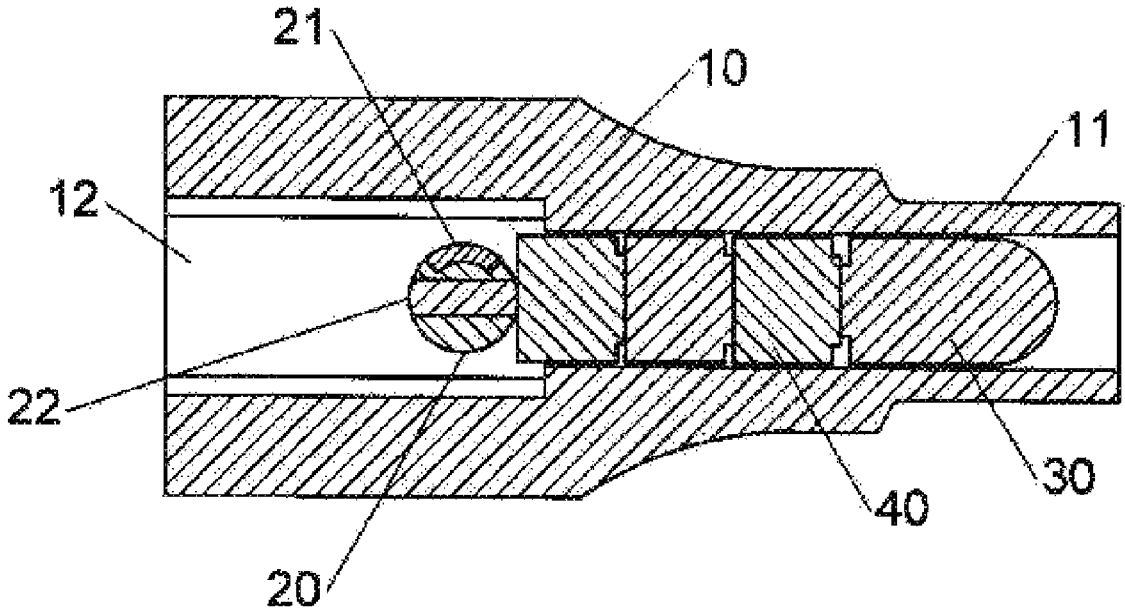
FIG. 13 shows the switch member is rotated and the first conduct member is in contact with the power supply unit.

Referring to FIGS. 12 and 13, the second recess 202 can be defined through the switch member 20 radially and the second conductive member 22 is engaged with the second recess 202. The third conductive portion 220 and the fourth conductive portion 221 are respectively located at the front and second faces of the switch member 20.

Figure 14:
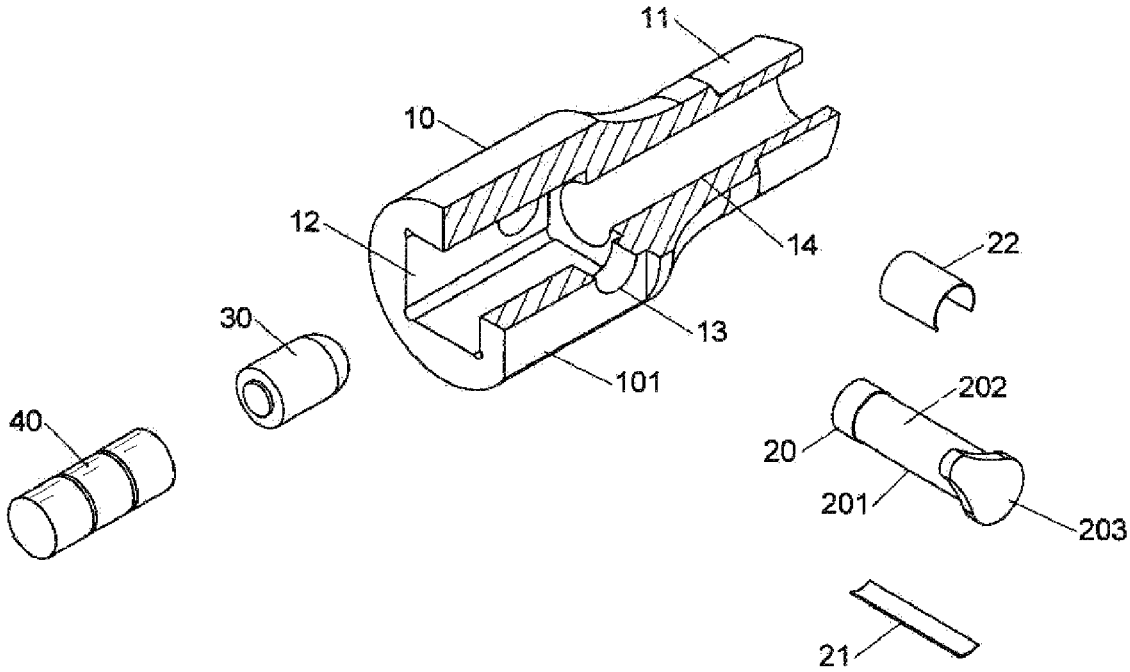
FIG. 14 shows an exploded view to show yet another embodiment of the extension bar with a built-in light of the present invention.

FIG. 14 shows that the first and second recesses 201, 202 are two curved recesses defined in an outer periphery and along an axis of the switch member 20, the first and second conductive members 21, 22 are two curved plates which are engaged with the first and second recesses 201, 202 respectively.

Figure 15:
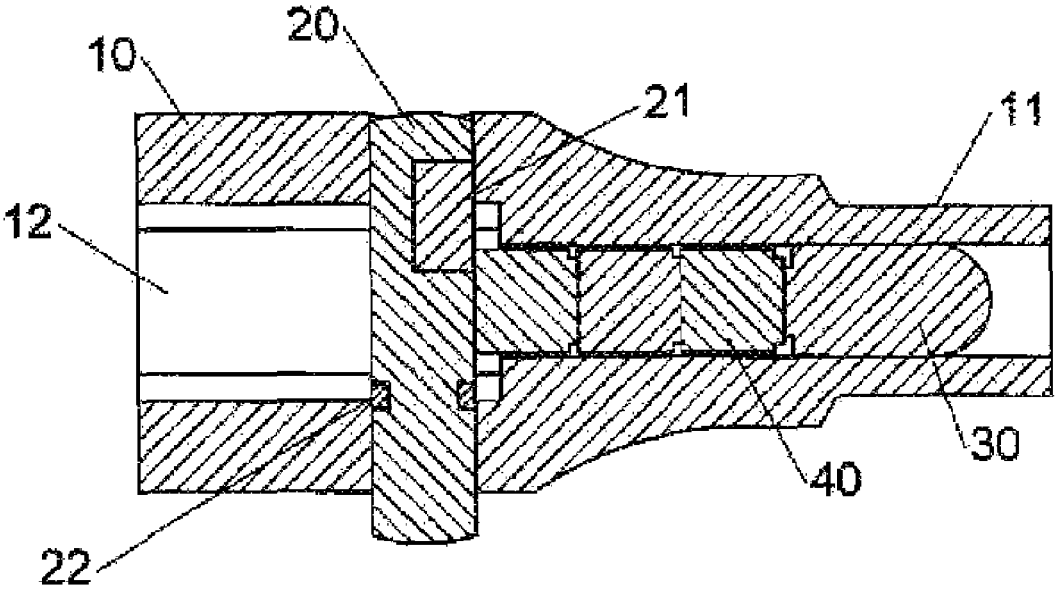
FIG. 15 is a cross sectional view to show the switch member is move to its first operation position.
Figure 16:
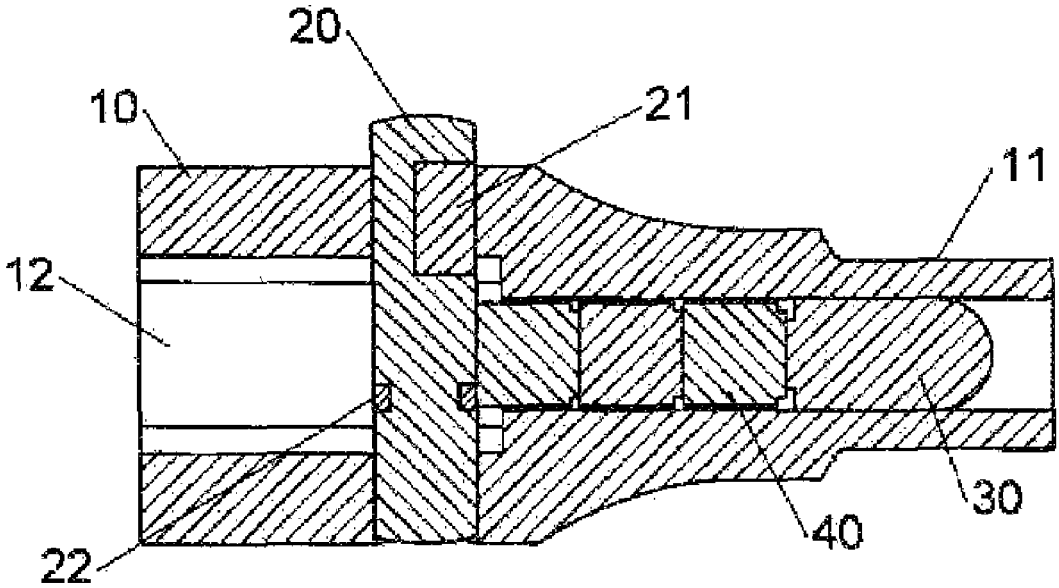
FIG. 16 is a cross sectional view to show the switch member is move to its second operation position.
Figure 17:
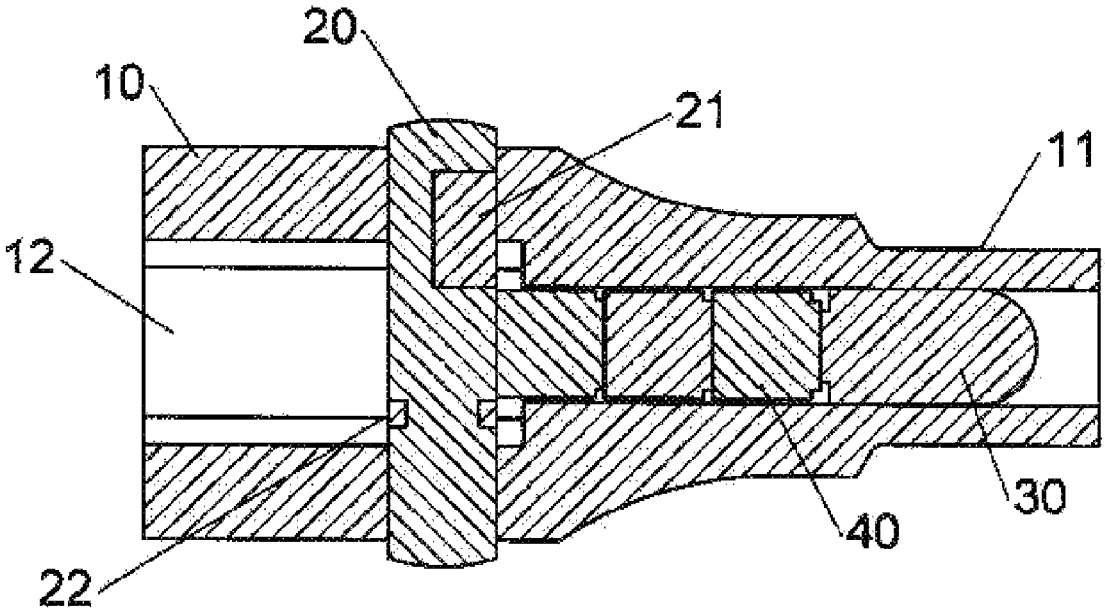
FIG. 17 is a cross sectional view to show the switch member is move to its third operation position.

FIGS. 15 and 16 show that the switch member 20 is operated in another way, the switch member 20 is movable along an axis of the transverse hole 13 between the first and second operation positions. FIG. 17 shows that the switch member 20 is operated to a third operation position where the first conductive member 2, the second conductive member 22 and the power supply unit 40 are not in contact with each other.

While we have shown and described the embodiment in accordance with the present invention, it should be clear to those skilled in the art that further embodiments may be made without departing from the scope of the present invention.

What is claimed is:

1. An extension bar with built-in light, comprising:

an elongate body made by conductive material and having a first end and an engaging recess defined in a second end of the elongate body, a transverse hole defined through the elongate body and communicating with the engaging recess, a passage defined axially through the elongate body and communicating with the engaging recess and defining an opening in the first end of the elongate body;

a switch member made by non-conductive material and extending through the transverse hole, the switch member including a first face toward the first end of the elongate body and a second face toward the second end of the elongate body, the switch member being arranged at a first operation position and a second operation position in the transverse hole, a first recess defined in the switch member and a first conductive member engaged with the first recess, a second recess defined in the switch member and a second conductive member engaged with the second recess;

a power supply unit and a light bulb received in the passage, the power supply unit having a first end facing the switch member and a second end of the power supply unit facing a first end of the light bulb, the first end of the light bulb made by conductive material and being in contact with an inner periphery of the passage, a second end of the light bulb facing the opening in the first end of the elongate body;

the first conductive member including a first conductive portion and a second conductive portion, the first conductive portion being in contact with the elongate body and the second conductive portion being removably in contact with the first end of the power supply unit, the second conductive member having a third conductive portion and a fourth conductive portion, the third conductive portion located in the first face of the switch member and the fourth conductive portion located in the second face of the switch member, and when the switch member is located at the first operation position, the third conductive portion of the second conductive member is in contact with the power supply unit, a conductive hand tool is inserted into the engaging recess and in contact with the elongate body and the fourth conductive portion of the second conductive member so as to form a first circuit via the conductive hand tool, the elongate body, the second conductive member, the power supply unit and the light bulb, the light bulb is activated, when the switch member is located at the second operation position, the first conductive portion of the first conductive member is in contact with the elongate body and the second conductive portion of the first conductive member is in contact with the power supply unit so as to form a second circuit via the first conductive member, the power supply unit and the light bulb and the elongate body, the light bulb is activated.

2. The extension bar as claimed in claim 1, wherein the first end of the elongate body is a rectangular end and the engaging recess is a rectangular recess.

3. The extension bar as claimed in claim 1, wherein the elongate body includes a first flat surface defined in an outer periphery thereof and a lever extends laterally from an end of the switch member, the lever is rested on the first flat surface.

4. The extension bar as claimed in claim 1, wherein the second recess is a curved recess defined in an outer periphery and along an axis of the switch member, the second conductive member is a curved plate which is engaged with the second recess.

5. The extension bar as claimed in claim 1, wherein the second recess is defined through the switch member and the second conductive member is engaged with the second recess.

6. The extension bar as claimed in claim 1, wherein the switch member is rotatable in the transverse hole between the first operation position and the second operation position.

7. The extension bar as claimed in claim 6, wherein the switch member is operated to a third operation position where the first conductive member, the second conductive member and the power supply unit are not in contact with each other.

8. The extension bar as claimed in claim 1, wherein the switch member is movably along an axis of the transverse hole between the first and second operation positions.

9. The extension bar as claimed in claim 8, wherein the switch member is operated to a third operation position where the first conductive member, the second conductive member and the power supply unit are not in contact with each other.

10. The extension bar as claimed in claim 1, wherein the first and second recesses are two curved recesses defined in an outer periphery and along an axis of the switch member, the first and second conductive members are two curved plates which are engaged with the first and second recesses respectively.

* * * * *